US010550630B2

(12) United States Patent
Xie

(10) Patent No.: US 10,550,630 B2
(45) Date of Patent: Feb. 4, 2020

(54) EXPANDABLE BATHROOM DOOR

(71) Applicant: SMMAX INDUSTRIAL LIMITED, Hong Kong (CN)

(72) Inventor: Huoxian Xie, Hong Kong (CN)

(73) Assignee: SMMAX INDUSTRIAL LIMITED, Hong Kong (CN)

( * ) Notice: Subject to any disclaimer, the term of this patent is extended or adjusted under 35 U.S.C. 154(b) by 171 days.

(21) Appl. No.: 15/739,119

(22) PCT Filed: Jun. 23, 2016

(86) PCT No.: PCT/CN2016/086945
§ 371 (c)(1),
(2) Date: May 2, 2018

(87) PCT Pub. No.: WO2016/206607
PCT Pub. Date: Dec. 29, 2016

(65) Prior Publication Data

US 2018/0252024 A1 Sep. 6, 2018

(30) Foreign Application Priority Data

Jun. 23, 2015 (CN) ..... 2015 2 0430763 U

(51) Int. Cl.

| | |
|---|---|
| ***E06B 3/92*** | (2006.01) |
| ***E06B 9/262*** | (2006.01) |
| ***E06B 3/80*** | (2006.01) |
| ***E05D 15/12*** | (2006.01) |
| ***E06B 1/52*** | (2006.01) |
| *E05F 17/00* | (2006.01) |
| *E06B 9/54* | (2006.01) |

(52) U.S. Cl.
CPC ..... *E06B 3/92* (2013.01); *E05D 15/12* (2013.01); *E06B 1/52* (2013.01); *E06B 3/805* (2013.01); *E06B 9/262* (2013.01); *E05F 2017/005* (2013.01); *E05Y 2201/654* (2013.01); *E05Y 2900/114* (2013.01); *E06B 2009/543* (2013.01)

(58) Field of Classification Search
CPC .... E06B 9/262; E06B 9/92; E06B 2009/2625; E06B 2009/543; E06B 1/52; E06B 3/805
See application file for complete search history.

(56) References Cited

U.S. PATENT DOCUMENTS 5,351,737 A * 10/1994 Hoshiyama ..... E06B 9/262 160/84.03
5,377,737 A * 1/1995 Moriya ..... E05F 1/025 160/190
5,456,303 A * 10/1995 Horinouchi ..... E06B 9/0692 160/84.04

(Continued)

*Primary Examiner* — Justin B Rephann

(57) ABSTRACT

A retractable bathroom door includes a fixed frame, a mobile frame, a first pull string and a foldable portion. The mobile frame is perpendicular to the upper frame portion of the fixed frame and horizontally moves in a frame range thereof. A frame portion at one side of the mobile frame has a first hollow structure. A first upper pulley and a first lower pulley are respectively disposed at a top end and a bottom end of the first hollow structure. The first pull string has two ends which are wound around the first upper pulley and the first lower pulley in a crossover manner. An upper rail and a lower rail are respectively disposed on the upper frame portion and the lower frame portion of the fixed frame. An upper strip and a lower strip are respectively disposed on the upper rail and the lower rail.

9 Claims, 9 Drawing Sheets

(56) References Cited

U.S. PATENT DOCUMENTS 5,477,904 A * 12/1995 Yang ..... B60J 1/2091 160/370.23
5,873,401 A * 2/1999 Tsuchida ..... E06B 9/262 160/84.04
6,186,212 B1 * 2/2001 Tsuchida ..... E06B 9/54 160/194
6,318,438 B1 * 11/2001 Uno ..... E06B 9/262 160/194
6,470,511 B1 * 10/2002 Smale ..... A47K 3/30 4/558
7,346,939 B2 * 3/2008 Perry ..... A47K 3/34 4/557
7,694,711 B2 * 4/2010 Okachi ..... E06B 9/54 160/122
7,963,312 B2 * 6/2011 Okachi ..... E06B 9/262 160/31
8,196,638 B2 * 6/2012 Roberts ..... E06B 9/54 160/194
9,004,138 B2 * 4/2015 Okachi ..... E06B 9/54 160/31
2004/0244919 A1 * 12/2004 Aoki ..... E06B 9/262 160/218
2006/0162871 A1 * 7/2006 Kamosawa ..... E06B 9/52 160/84.06
2007/0029053 A1 * 2/2007 Moriya ..... E06B 9/262 160/84.06
2007/0039698 A1 * 2/2007 Chino ..... E06B 9/54 160/84.06
2007/0068633 A1 * 3/2007 Chino ..... E06B 9/52 160/31
2009/0266495 A1 * 10/2009 Karasawa ..... E06B 9/262 160/84.03
2010/0032109 A1 * 2/2010 Okachi ..... E06B 9/262 160/372
2011/0203752 A1 * 8/2011 Okachi ..... E06B 9/54 160/372
2013/0118694 A1 * 5/2013 Moriya ..... E06B 9/262 160/84.04

* cited by examiner

EXPANDABLE BATHROOM DOOR

CROSS REFERENCE OF RELATED APPLICATION

This is a U.S. National Stage under 35 U.S.C 371 of the International Application PCT/CN2016/086945, filed Jun. 23, 2016, which claims priority under 35 U.S.C. 119(a-d) to CN 201520430763.X, filed Jun. 23, 2015.

BACKGROUND OF THE PRESENT INVENTION

Field of Invention

The present invention relates to a retractable bathroom door.

Description of Related Arts

At present, the existing bathroom doors on the market mainly include two types of glass revolving doors and sliding doors. Due to large size, high quality and vulnerability, the glass revolving doors and the sliding doors will bring a series of inconveniences and dangers to producers and consumers in the installation, use and transport process, and also need more packaging materials, expensive transportation costs and larger installation space. If the installation space is limited, the installation of the bathroom door is limited. Therefore, it is an urgent problem to be solved for developing a bathroom door which is suitable for small space installation.

SUMMARY OF THE PRESENT INVENTION

An object of the present invention is to provide a retractable bathroom door, which is able to solve technical problems of existing bathroom doors, such as large size, vulnerability, inconvenient installation and it is not suitable for installation in small space. Specific technical solutions of the present invention are as follows.

A retractable bathroom door comprises a fixed frame, a mobile frame, a first pull string and a foldable portion, wherein the fixed frame comprises an upper frame portion and a lower frame portion both of which are parallel to a horizontal surface, and a left frame portion and a right frame portion both of which are perpendicular to the horizontal surface; the upper frame portion, the lower frame portion, the left frame portion and the right frame portion are connected with each other end to end in sequence; the mobile frame is perpendicular to the upper frame portion and horizontally moves in a frame range of the fixed frame; a frame portion at one side of the mobile frame has a first hollow structure; a first upper pulley and a first lower pulley are respectively disposed at a top end and a bottom end of the first hollow structure; the first pull string has two ends which are connected and wound around the first upper pulley and the first lower pulley in a crossover manner; an upper rail is disposed on the upper frame portion, a lower rail is disposed on the lower frame portion; an upper strip is disposed on the upper rail, a lower strip is disposed on the lower rail; the top end and the bottom end of the first hollow structure has a first upper opening and a first lower opening, respectively; one end of the upper strip enters the first hollow structure from the first upper opening and is connected with the first pull string; one end of the lower strip enter the first hollow structure from the first lower opening and is connected with the first pull string; a length of the upper strip disposed on the upper rail is the same as a length of the lower strip disposed on the lower rail; the foldable portion is disposed between two mobile frame portions of the mobile frame.

Further, a left frame portion of the mobile frame is fixed with the left frame portion of the fixed frame; one end of the upper strip enters the first hollow structure from the first upper opening and is connected with the first pull string, the other end of the upper strip is fixedly connected with a top end of the left frame portion of the mobile frame; one end of the lower strip enters the first hollow structure from the first lower opening and is connected with the first pull string, the other end of the lower strip is fixedly connected with a bottom end of the left frame portion of the mobile frame; a right frame portion of the mobile frame, having a hollow structure, is retractably pulled.

Further, the left frame portion of the mobile frame is fixedly connected with the left frame portion of the fixed frame through a lock structure.

Further, the right frame portion of the mobile frame has the first hollow structure, the left frame portion of the mobile frame has a second hollow structure; a top end and a bottom end of the second hollow structure have a second upper opening and a second lower opening, respectively; a second upper pulley and a second lower pulley are respectively disposed at the top end and the bottom end of the second hollow structure; a second pull string has two ends which are connected and wound around the second upper pulley and the second lower pulley in a crossover manner; one end of the upper strip is connected with the first push string, the other end of the upper strip is connected with the second push string; one end of the lower strip is connected with the first push string, the other end of the lower strip is connected with the second push string.

Further, a length of the upper strip is the same as a length of the lower strip, and a length of the upper strip entering the first hollow structure is the same as a length of the lower strip entering the first hollow structure.

Further, both the first upper pulley and the first lower pulley are fixed to an inner wall of the frame portion at one side of the mobile frame through a fixed shaft.

Further, an arc-shaped corner is disposed at an opening of both the upper strip and the lower strip entering the first hollow structure, so as to allow the strips to smoothly enter the first hollow structure of the mobile frame from the openings of both the upper strip and the lower strip entering the first hollow structure.

Further, both the upper frame portion and the lower frame portion of the fixed frame have a retractable structure with a changeable length which comprises multiple tube bodies axially sleeved with each other.

Further, the foldable portion is a foldable nanometer waterproof fabric.

Further, the lower frame portion of the fixed frame is connected with a waterproof board, and a height of the waterproof board is larger than a height of the lower frame portion of the fixed frame.

Compared with the prior art, the retractable bathroom door provided by the present invention has main beneficial effects as follows. The foldable portion is disposed on the mobile frame, the mobile frame moves in the range of the fixed frame, the mobile frame is convenient to be pushed and pulled; the foldable portion is small in quality, is able to be a foldable nanometer waterproof fabrics, is low in manufacturing cost and easy to be installed. The mobile frame has the hollow structure, the first pull string winds around both the first upper pulley and the first lower pulley, both the upper strip and the lower strip are connected with the first pull string, so that the length of the upper strip entering the hollow structure is the same as the length of the lower strip entering the hollow structure, the length of the upper strip disposed on the upper rail is the same as the length of the lower strip disposed on the lower rail, thus achieving the beneficial effect that the mobile frame is able to horizontally stably move in the pull and push process.

DETAILED DESCRIPTION OF THE PREFERRED EMBODIMENT

Figure 1:
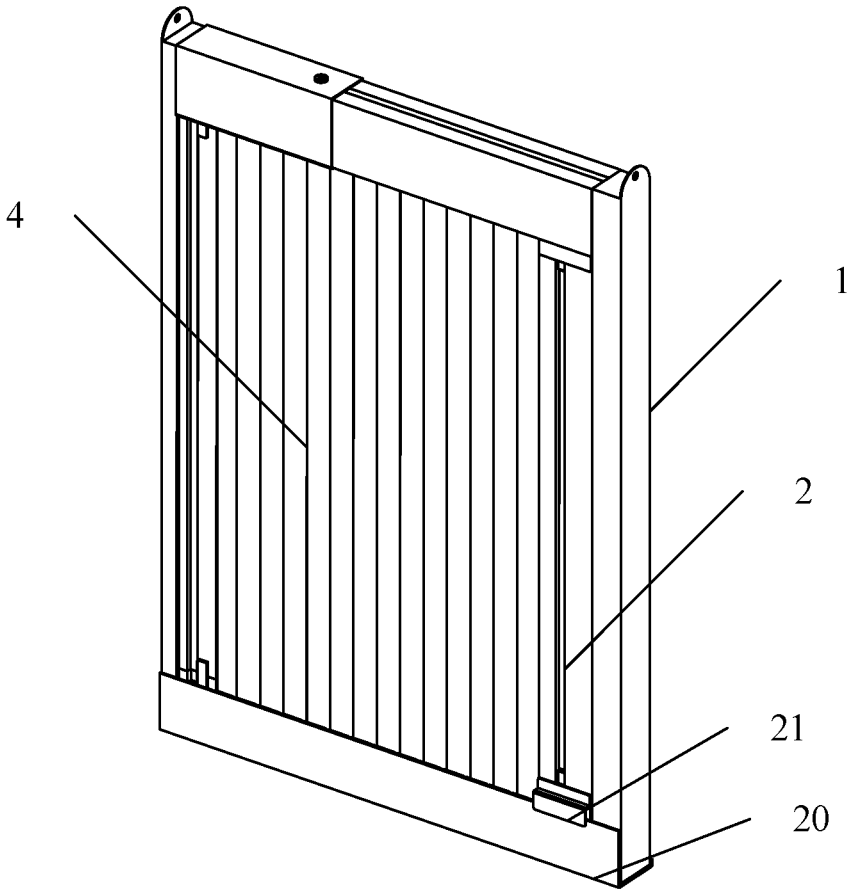
FIG. 1 is a structurally schematic view of a retractable bathroom door according to a first embodiment of the present invention.

In order to make the objectives, technical solutions and advantages of the present invention clearer, the present invention will be further described in detail with reference to the accompanying drawings and embodiments. It should be understood that the specific embodiments described herein are merely used to explain the present invention and are not intended to limit the present invention.

First Embodiment

Referring to FIGS. 1 to 7, a retractable bathroom door according to a first embodiment of the present invention is illustrated, which comprises a fixed frame 1, a mobile frame 2, a first pull string 3 and a foldable portion 4, wherein the fixed frame 1 comprises an upper frame portion 101 and a lower frame portion 102 both of which are parallel to a horizontal surface, and a left frame portion 103 and a right frame portion 104 both of which are perpendicular to the horizontal surface; the upper frame portion 101, the lower frame portion 102, the left frame portion 103 and the right frame portion 104 are connected with each other end to end in sequence; the mobile frame 2 is perpendicular to the upper frame portion 101 and horizontally moves in a frame range of the fixed frame 1; a frame portion at one side of the mobile frame 2 has a first hollow structure 13; a first upper pulley 5 and a first lower pulley 6 are respectively disposed at a top end and a bottom end of the first hollow structure 13; both the first upper pulley 5 and the first lower pulley 6 are fixed to an inner wall of the frame portion at one side of the mobile frame 2 through a fixed shaft 51.

The first pull string 3 has two ends which are connected and wound around the first upper pulley 5 and the first lower pulley 6 in a crossover manner; an upper rail 201 is disposed on the upper frame portion 101, a lower rail 202 is disposed on the lower frame portion 102; an upper strip 9 is disposed on the upper rail 201, a lower strip 10 is disposed on the lower rail 202; the top end and the bottom end of the first hollow structure 13 has an upper opening and a lower opening, respectively; one end of the upper strip 9 enters the first hollow structure 13 from a first upper opening 7 and is connected with the first pull string 13; one end of the lower strip 10 enter the first hollow structure 13 from a first lower opening 8 and is connected with the first pull string 3; a length of the upper strip 9 is the same as a length of the lower strip 10, a length of the upper strip 9 entering the first hollow structure is the same as a length of the lower strip 10 entering the first hollow structure, a length of the upper strip 9 disposed on the upper rail 201 is the same as a length of the lower strip 10 disposed on the lower rail 202; the foldable portion 4 is disposed between two mobile frame portions of the mobile frame and is a foldable nanometer waterproof fabrics.

Figure 2:
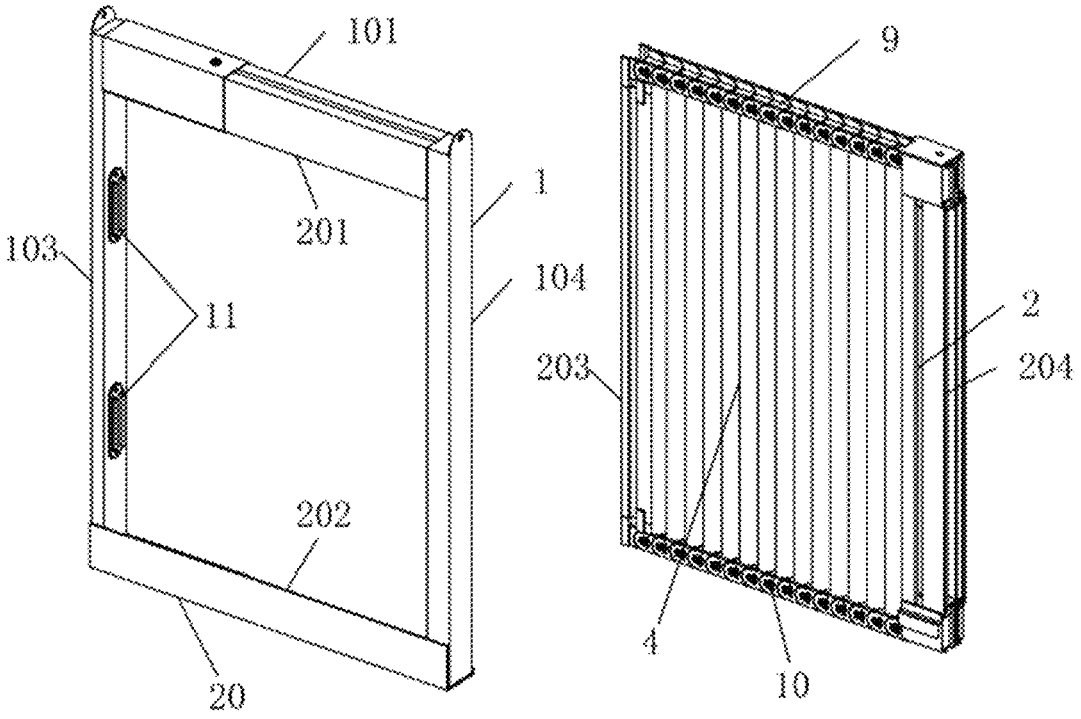
FIG. 2 is another structurally schematic view of the retractable bathroom door according to the above first embodiment of the present invention.
Figure 4:
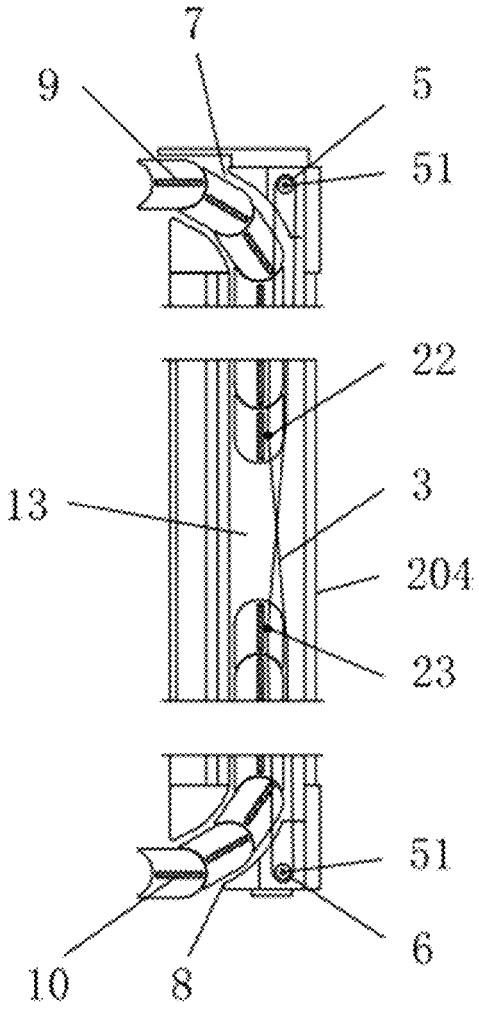
FIG. 4 is a partially enlarged view of FIG. 3.

As shown in FIG. 2, a left frame portion 203 of the mobile frame 2 is fixed with the left frame portion 103 of the fixed frame 1 through a lock structure 11; as shown in FIG. 4, one end of the upper strip 9 enters the first hollow structure 13 from the first upper opening 7 and is connected with the first pull string 3, the other end of the upper strip 9 is fixedly connected with a top end of the left frame portion 203 of the mobile frame 2; one end of the lower strip 10 enters the first hollow structure 13 from the first lower opening 8 and is connected with the first pull string 3, the other end of the lower strip 10 is fixedly connected with a bottom end of the left frame portion 203 of the mobile frame 2; a right frame portion 204 of the mobile frame 2, having the first hollow structure, is retractably pulled.

An arc-shaped corner 12 is disposed at an opening of both the upper strip 9 and the lower strip 10 entering the first hollow structure 13, so as to allow the strips to smoothly enter the first hollow structure 13 of the mobile frame from the openings of both the upper strip 9 and the lower strip 10 entering the first hollow structure 13.

Figure 3:
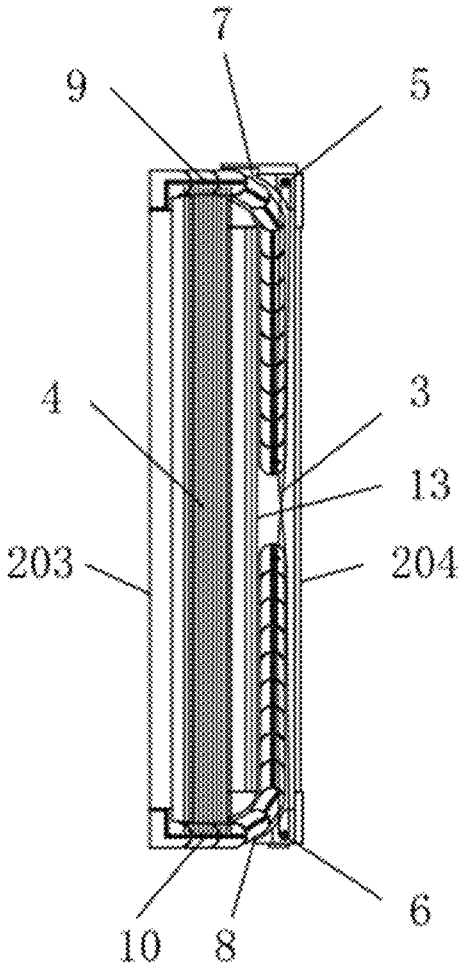
FIG. 3 is a structurally schematic view of a mobile frame at a retracted state according to the above first embodiment of the present invention.

It should be noted that, as shown in FIG. 3, when the right frame portion of the mobile frame 2 is pulled towards a right, as shown in FIG. 4, a movable end 22 of the upper strip 9 (which is a joint of the upper strip 9 and the first pull string 3) moves upwardly in the first hollow structure 13, the first pull string 3 drives a movable end 23 (which is a joint of the lower strip 10 and the first pull string 3) of the lower strip 10 to move downwardly in the first hollow structure 13, a moving distance of the upper strip 9 is the same as a moving distance of the lower strip 10.

Figure 5:
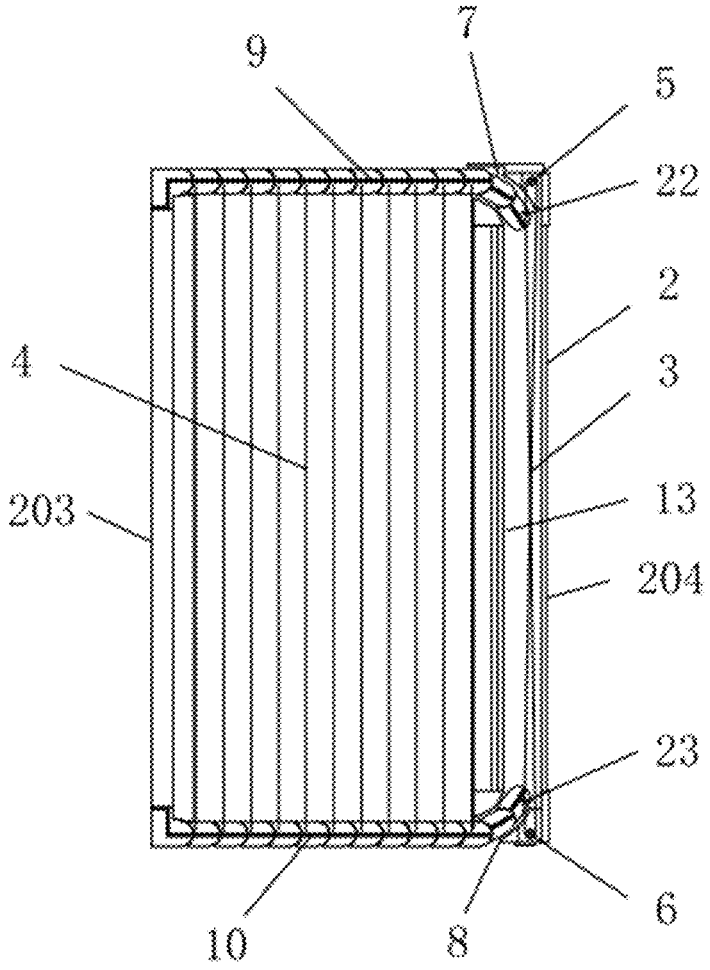
FIG. 5 is a structurally schematic view of the mobile frame at an extended state according to the above first embodiment of the present invention.
Figure 6:
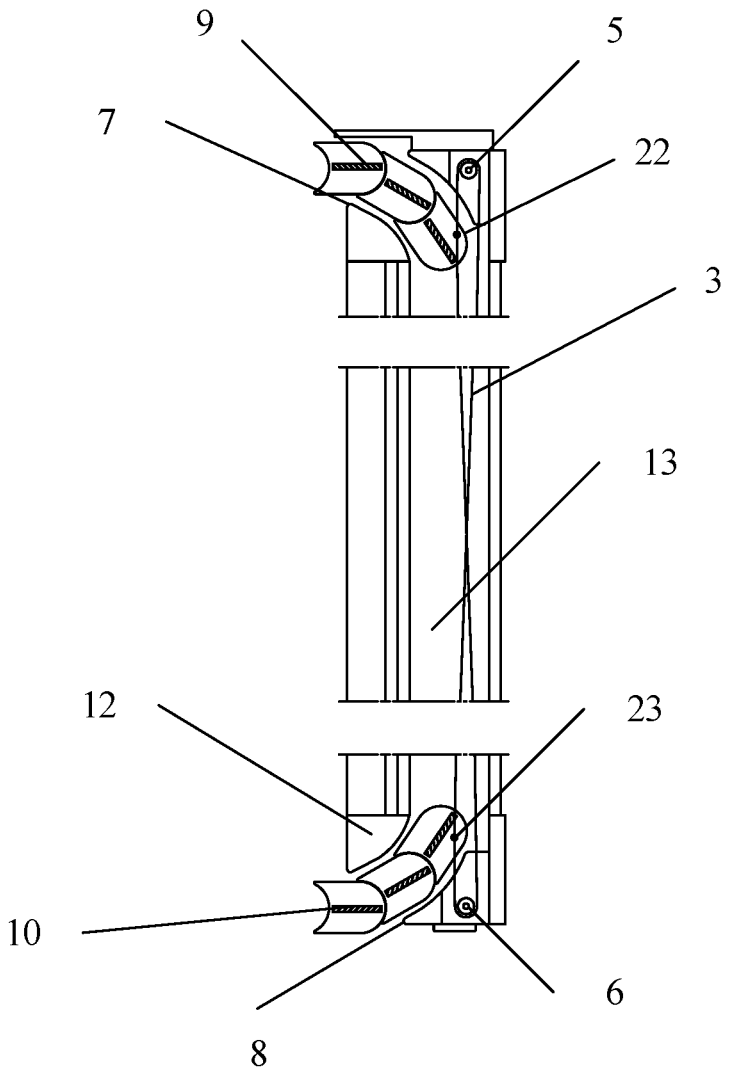
FIG. 6 is a partially enlarged view of FIG. 5.

Referring to FIG. 5, when the right frame portion of the mobile frame 2 is pulled towards a left, as shown in FIG. 6, the movable end 22 of the upper strip 9 moves downwardly in the first hollow structure 13, the first pull string 3 drives the movable end 23 of the lower strip 10 to move upwardly in the first hollow structure 13, and at this time, the moving distance of the upper strip 9 is the same as the moving distance of the lower strip 10.

Figure 7:
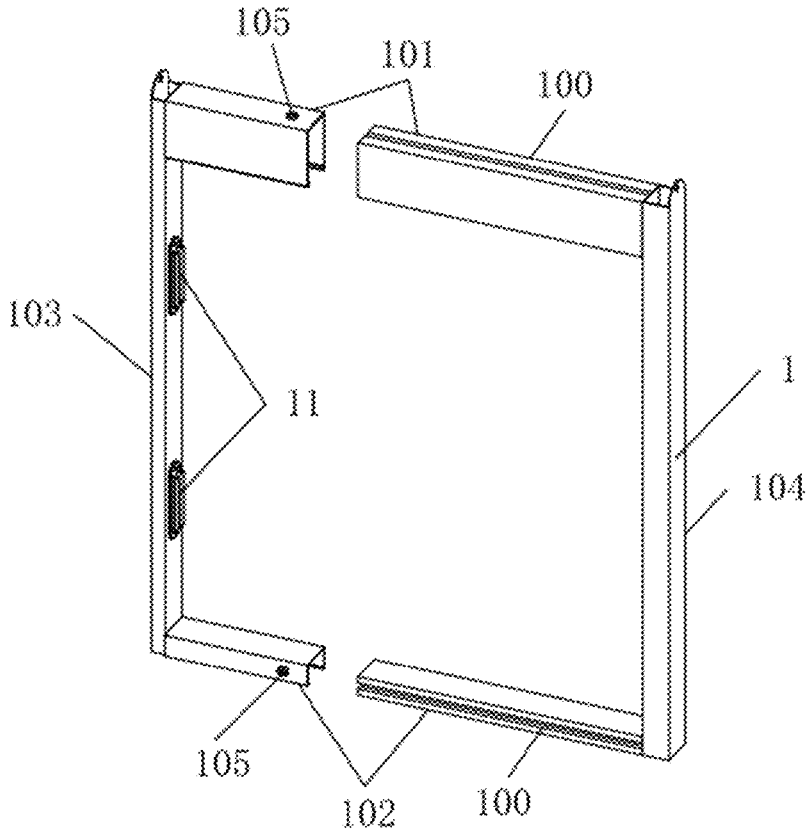
FIG. 7 is a structurally schematic view of a fixed frame according to the above first embodiment of the present invention.

In spite that the right frame portion of the mobile frame 2 is pulled towards the right or the left, the right frame portion of the mobile frame 2 always horizontally moves under an action of the first pull string 3; in spite that a force is applied to any force point on the mobile frame, the mobile frame 2 is pushed and pulled stably to horizontally move. Further, as shown in FIG. 7, both the upper frame portion and the lower frame portion of the fixed frame 1 have a retractable structure with a changeable length which comprises multiple tube bodies 100 axially sleeved with each other. Both the upper frame portion and the lower frame portion of the fixed frame 1 have screw holes, the upper frame portion and the lower frame portion of the fixed frame 1 are adjusted to an appropriate width according to actual installation needs, two tube bodies 100 of both the upper frame portion and the lower frame portion of the fixed frame are respectively fixed through locking screws 105. In the prior art, the bathroom door has a fixed width which is unable to be adjusted, so that in an actual installation process, the width of the fixed frame 1 is inconsistent with a width of an actual installation site, thus too wide or too narrow situation will appear. The present invention effectively solves the above technical problem, is able to adjust the width of the fixed frame 1 according to actual needs, is simple in installation and convenient to be used.

Further, as shown in FIG. 1, the lower frame portion of the fixed frame 1 is connected with a waterproof board 20 having an L-shape. The L-shaped waterproof board comprises a horizontal plate and a vertical plate, wherein a height of the vertical plate of the waterproof board 20 is larger than a height of the lower frame portion of the fixed frame 1, so as to prevent water at an inner side of the fixed frame 1 from flowing towards an outer side of the fixed frame 1.

Further, a push-pull guide plate 21 is disposed on the mobile frame 2.

Second Embodiment

Figure 8:
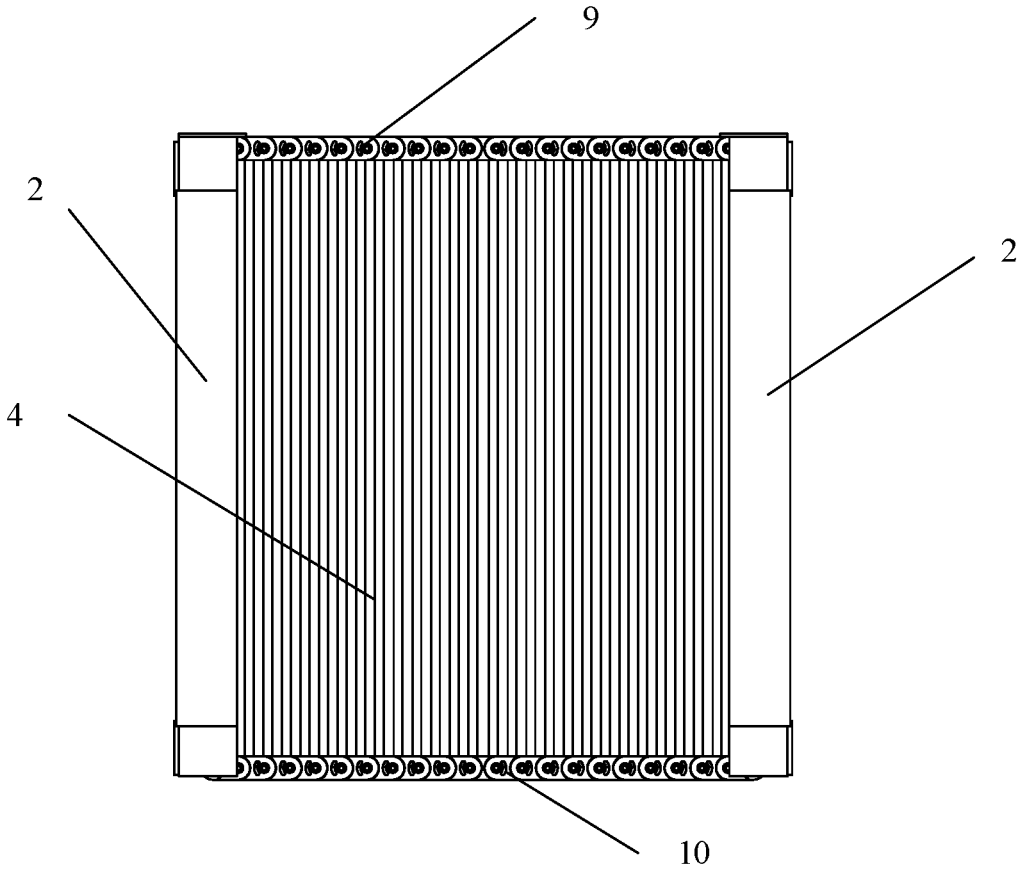
FIG. 8 is a structurally schematic view of a retractable bathroom door according to a second embodiment of the present invention.
Figure 9:
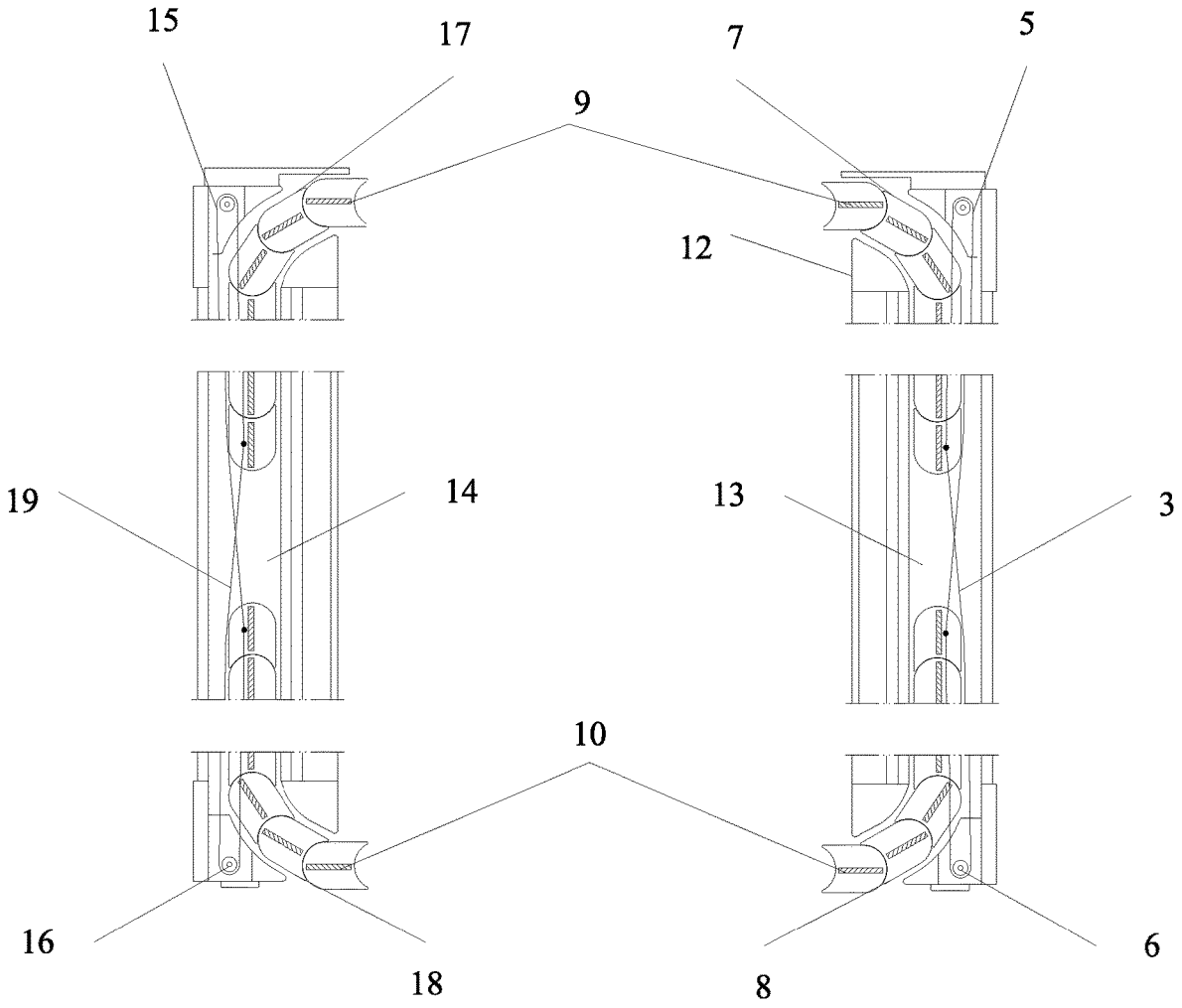
FIG. 9 is a partially enlarged schematic view of a mobile frame according to the second embodiment of the present invention.

Referring to FIGS. 8 and 9, a retractable bathroom door according to a second embodiment of the present invention is illustrated based on the first embodiment. In the first embodiment, the right frame portion of the mobile frame 2 has the first hollow structure 13. In the second embodiment, the left frame portion of the mobile frame 2 has a second hollow structure 14, wherein a top end and a bottom end of the second hollow structure 14 has a second upper opening 17 and a second lower opening 18, respectively; a second upper pulley 15 and a second lower pulley 16 are respectively disposed at the top end and the bottom end of the second hollow structure 14; a second pull string 19 has two ends which are connected and wound around the second upper pulley 15 and the second lower pulley 15 in a crossover manner; one end of the upper strip 9 is connected with the first push string 3, the other end of the upper strip 9 is connected with the second push string 19; one end of the lower strip 10 is connected with the first push string 3, the other end of the lower strip 10 is connected with the second push string 19.

In the retractable bathroom door according to the second embodiment of the present invention, both the left frame portion and the right frame portion of the mobile frame 2 are pulled to achieve push and pull on both sides; the first push string 3 and the second push string 19 at two sides of the mobile frame respectively pull the left frame portion and the right frame portion of the mobile frame 2, which is the same as the first embodiment in working principle, no description is repeated here. It should be noted that in the second embodiment, the mobile frame 2 is pulled at both sides to achieve double retractable width of the first embodiment in which the mobile frame 2 is pulled at one side, which facilitates usage and has wide application range.

It should be noted that the working principle of the retractable bathroom door is able to be applied to sunshade, waterproof and other types of doors and windows. Other types of doors and windows based on the working principle of the present invention are within the protection scope of the present application.

It should be noted that the above embodiments are merely intended for describing the technical solutions of the present application rather than limiting the present invention. Although the present application is described in detail with reference to the preferred embodiments, those skilled in the art should understand that any modification or equivalent substitution without departing from the spirit and scope of the technical solutions of the present invention should be covered by the scope of the claims of the present invention.

What is claimed is:

1. A retractable bathroom door, comprising: a fixed frame, a mobile frame, a first pull string and a foldable portion, wherein:

the fixed frame comprises an upper frame portion and a lower frame portion both of which are parallel to a horizontal surface, and a left frame portion and a right frame portion both of which are perpendicular to the horizontal surface; the upper frame portion, the lower frame portion, the left frame portion and the right frame portion are connected with each other end to end in sequence; the mobile frame is perpendicular to the upper frame portion and horizontally moves in a frame range of the fixed frame; a frame portion at one side of the mobile frame has a first hollow structure; a first upper pulley and a first lower pulley are respectively disposed at a top end and a bottom end of the first hollow structure; the first pull string has two ends which are connected and wound around the first upper pulley and the first lower pulley in a crossover manner; an upper rail is disposed on the upper frame portion, a lower rail is disposed on the lower frame portion; an upper strip is disposed on the upper rail, a lower strip is disposed on the lower rail; the top end and the bottom end of the first hollow structure has a first upper opening and a first lower opening, respectively; one end of the upper strip enters the first hollow structure from the first upper opening and is connected with the first pull string; one end of the lower strip enter the first hollow structure from the first lower opening and is connected with the first pull string; a length of the upper strip disposed on the upper rail is the same as a length of the lower strip disposed on the lower rail; the foldable portion is disposed between two mobile frame portions of the mobile frame;

both the upper frame portion and the lower frame portion of the fixed frame have a retractable structure with a changeable length which comprises multiple tube bodies axially sleeved with each other.

2. The retractable bathroom door, as recited in claim 1, wherein the foldable portion is a foldable nanometer waterproof fabrics.

3. The retractable bathroom door, as recited in claim 1, wherein the lower frame portion of the fixed frame is connected with a waterproof board, a height of the waterproof board is larger than a height of the lower frame portion of the fixed frame.

4. The retractable bathroom door, as recited in claim 1, wherein a left frame portion of the mobile frame is fixed with the left frame portion of the fixed frame; one end of the upper strip enters the first hollow structure from the first upper opening and is connected with the first pull string, another end of the upper strip is fixedly connected with a top end of the left frame portion of the mobile frame; one end of the lower strip enters the first hollow structure from the first lower opening and is connected with the first pull string, another end of the lower strip is fixedly connected with a bottom end of the left frame portion of the mobile frame; a right frame portion of the mobile frame, having the first hollow structure, is retractably pulled.

5. The retractable bathroom door, as recited in claim 4, wherein the left frame portion of the mobile frame is fixedly connected with the left frame portion of the fixed frame through a lock structure.

6. The retractable bathroom door, as recited in claim 1, wherein the right frame portion of the mobile frame has the first hollow structure, the left frame portion of the mobile frame has a second hollow structure; a top end and a bottom end of the second hollow structure have a second upper opening and a second lower opening, respectively; a second upper pulley and a second lower pulley are respectively disposed at the top end and the bottom end of the second hollow structure; a second pull string has two ends which are connected and wound around the second upper pulley and the second lower pulley in a crossover manner; one end of the upper strip is connected with the first pull string, another end of the upper strip is connected with the second pull string; one end of the lower strip is connected with the first pull string, another end of the lower strip is connected with the second pull string.

7. The retractable bathroom door, as recited in claim 1, wherein a length of the upper strip is the same as a length of the lower strip, and a length of the upper strip entering the first hollow structure is the same as a length of the lower strip entering the first hollow structure.

8. The retractable bathroom door, as recited in claim 1, wherein both the first upper pulley and the first lower pulley are fixed to an inner wall of the left frame portion or the right frame portion of the mobile frame through a fixed shaft.

9. The retractable bathroom door, as recited in claim 1, wherein an arc-shaped corner is disposed at an opening of both the upper strip and the lower strip entering the first hollow structure, so as to allow the upper strip and the lower strip to smoothly enter the first hollow structure of the mobile frame from the openings of both the upper strip and the lower strip entering the first hollow structure.

* * * * *